US006508603B1

(12) United States Patent
Vasas

(10) Patent No.: US 6,508,603 B1
(45) Date of Patent: Jan. 21, 2003

(54) MASCARA BRUSH CONFIGURED FOR LOADING FROM SIDEWALL OF CONTAINER

(75) Inventor: Martin M. Vasas, Fairfield, CT (US)

(73) Assignee: The Bridgeport Metal Goods Manufacturing Company

( * ) Notice: Subject to any disclaimer, the term of this patent is extended or adjusted under 35 U.S.C. 154(b) by 0 days.

(21) Appl. No.: 09/997,488

(22) Filed: Nov. 19, 2001

Related U.S. Application Data

(60) Provisional application No. 60/249,558, filed on Nov. 17, 2000.

(51) Int. Cl.[7] ..... A46B 11/00

(52) U.S. Cl. ..... 401/129; 401/126; 401/122

(58) Field of Search ..... 401/129, 126, 401/127, 121, 122, 119; 15/206, 207, 207.2; D28/7; 132/216, 217, 218

(56) References Cited

U.S. PATENT DOCUMENTS

| | | | | |
|---|---|---|---|---|
| 2,194,916 A | * | 3/1940 | Somers | 401/129 |
| 5,226,744 A | | 7/1993 | Kemmerer | |
| 5,328,282 A | * | 7/1994 | Charrier et al. | 401/129 |
| 5,611,361 A | * | 3/1997 | Leone | 132/218 |
| 5,621,941 A | * | 4/1997 | Liu | 15/16 |
| 5,700,100 A | | 12/1997 | Ackermann | |
| 6,003,519 A | * | 12/1999 | Gueret | 132/218 |
| 6,220,254 B1 | * | 4/2001 | Gueret | 401/129 |
| 6,309,125 B1 | * | 10/2001 | Peters | 401/129 |

FOREIGN PATENT DOCUMENTS

IT 00137 11/1996

OTHER PUBLICATIONS

Cardia Industrial Design, "A New Mascara Applicator".

* cited by examiner

*Primary Examiner*—David J. Walczak
(74) *Attorney, Agent, or Firm*—Ware, Fressola, Van Der Sluys & Adolphson LLP

(57) ABSTRACT

A mascara container has an elongated bottle with a continuous sidewall defining a product reservoir. The bottle has a threaded neck with an apertured wiper mounted thereon, providing access to the product reservoir. A cap is removably threaded onto the neck of the bottle, and a rod extends from the cap through the apertured wiper when the cap is secured on the bottle. The rod has a distal end positioned generally centrally with respect to the continuous sidewall, and a brush is mounted at the distal end of the rod. The brush has a first portion extending outwardly toward the continuous sidewall, and a second portion extending downwardly along the continuous side wall, at least said second portion of the brush having bristles deployed for sweeping product from the continuous sidewall of the elongated bottle as the threaded cap is removed from and replaced on the threaded neck of the bottle.

20 Claims, 2 Drawing Sheets

MASCARA BRUSH CONFIGURED FOR LOADING FROM SIDEWALL OF CONTAINER

PRIORITY

This application claims priority to my provisional patent application serial No. 60/249,588, filed Nov. 17, 2000.

FIELD OF THE INVENTION

The invention herein relates to a cosmetics brush for use in an elongated mascara container, the brush adapted to accumulate mascara from sidewall of the container.

BACKGROUND OF THE INVENTION

Mascara containers generally have an elongated bottle defining a reservoir with mascara product therein, and a cap with an applicator rod and brush on the end thereof. The bottle has a threaded neck and wiper. To close the container, the rod and brush are inserted through the wiper and the cap is screwed onto the threaded neck of the bottle. The brush picks up mascara in the reservoir when the cap is on the bottle.

To apply the mascara, the cap is unscrewed and the rod and brush are withdrawn through the wiper. The wiper removes excess mascara, and leaves the desired amount on the brush for application.

Between uses, the bottle may be in a horizontal orientation, such as in a purse or a makeup bag. The mascara may then accumulate along one side of the reservoir, and load the brush along that side. Also, because the brush is generally inserted along the axis of the elongated bottle, mascara may accumulate on all of the sidewalls and not contact the brush for loading.

Italian patent 1,263,206 shows a mascara container in which the brush is placed on the end of a bent rod, so that the brush contacts the sidewall of the container. While this causes contact between the brush and the container wall, the configuration does not maximize the ease of construction, flexibility, brush loading or application possibilities described below.

SUMMARY OF THE INVENTION

It is a principal object of the invention to provide an improved mascara container wherein the brush is configured to load mascara from the sidewalls of the product reservoir.

According to the invention herein, a mascara container comprises an elongated bottle having a continuous sidewall defining a product reservoir. The bottle has a threaded neck and wiper providing access to the product reservoir. The mascara container also has a cap removably threaded onto the neck of the bottle, the cap having a rod extending through the wiper into the product reservoir, and a brush deployed on the distal end of the rod. The rod is generally axially received in the elongated bottle, and the brush at the distal end of the rod extends outwardly toward the continuous sidewall of the bottle and thereafter downwardly along the continuous sidewall of the bottle. Rotation of the cap in unscrewing it from the neck of the bottle also revolves the brush about the axis of the bottle, with the brush thereby sweeping or wiping the continuous sidewall of the bottle.

Other objects and features of the invention will in part be readily understood by those skilled in the art and will in part appear from the following description of the preferred embodiments and the claims, taken together with the drawings.

BRIEF DESCRIPTION OF DRAWINGS

The same reference numerals refer to the same elements throughout various figures.

DESCRIPTION OF PREFERRED EMBODIMENTS

Figure 1:
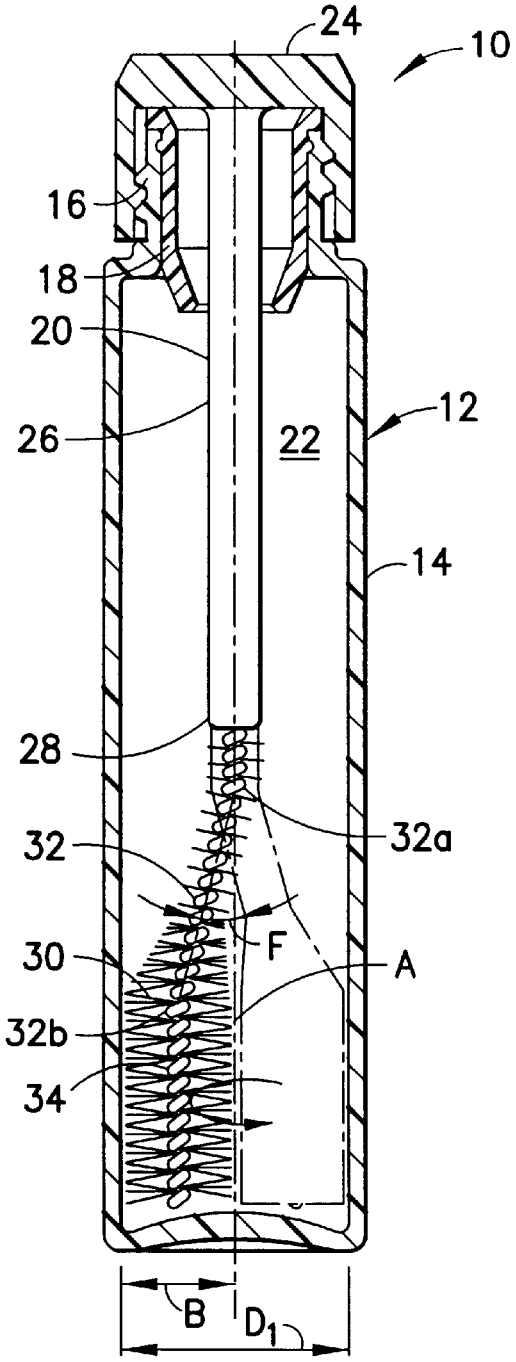
FIG. 1 is a cross sectional view of a cosmetics container according to the invention herein.

FIG. 1 illustrates a mascara container 10 having an elongated bottle 12 with a continuous sidewall 14. The bottle has a threaded neck 16 in which a wiper 18 is positioned. The wiper 18 defines a wiper orifice 20. The bottle 12 defines a reservoir 22, in which mascara (not shown) is contained. The sidewall 14 is cylindrical with an axis A. In the embodiment shown, the bottle has an outside diameter of about 0.510 inches and an inside diameter Di of about 0.450 inches. Bottles with inside diameters in the range of about 0.500 inches to about 0.800 inches may be used. The wiper orifice 20 is centered on the axis A, so that the axis of the rod is also designated at A.

The mascara container 10 further includes a cap 24 which is threadably received on the neck 16. The cap 24 has a rod 26 extending downwardly therefrom through the wiper orifice 20 and into the product reservoir 22, along the axis A. A brush 30 is secured to the distal end 28 of the rod 26. The brush 30 has a twisted wire stem 32 and a plurality of radially extending bristles 34. The brush 30 is characterized in that the twisted wire stem 32 is bent into a first portion 32*a* which extends outwardly from the longitudinal axis A of the rod 26 and bottle 12 at an angle F of approximately 15 degrees, and a second portion 32*b* which extends downwardly and is substantially parallel to and offset from the axis A. The bristles 34 extending from stem portion 32*b* have sufficient length that their tips either touch or lie closely adjacent to the sidewall 14 of the bottle 12.

In the embodiment shown, the portion of brush 30 including stem 32*b* has a diameter B of about 0.250 inches, and just touches the sidewall 14. Thus, the twisted wire stem 32*b* is offset from the axis A by about 0.100 inches. It will be appreciated that these dimensions are subject to manufacturing tolerances in trimming the brush and in bending the brush and attaching it to the rod. It is satisfactory that the brush either lightly engage and wipe the sidewall, or that it come close to the sidewall, as the result of manufacturing tolerances. Also, different dimensions may be used that place the outer surface of the brush at or near the sidewall, e.g. a somewhat larger diameter brush with less offset. Brushes with diameters in the range of about 0.200 inches to about 0.400 inches may be used with the appropriate offset.

The upper stem portion 32*a* also preferably has bristles, which may be shorter than the bristles extending from portion 32*b* of the twisted wire stem.

When the cap 24 is unscrewed from the threaded neck 16 of bottle 12, the applicator rod 26 is also rotated. This causes portion 32*b* of the twisted wire stem 32 being offset from the axis A to revolve about the axis A, with the bristles extending from stem portion 32*b* adjacent the continuous sidewall 14 of the bottle 12. Thus, these bristles of the brush 30 pick up mascara from the entire inside circumference of the sidewall 14 of the bottle 12, and also mix and stir mascara lying against the sidewall 14, keeping pigments well dispersed and preventing drying and caking of the surface of the mascara. After the cap is unscrewed, the applicator and brush are withdrawn for use. Because of the offset in brush 30, it also tends to wipe and stir mascara in the upper portion of bottle 12 as the brush is withdrawn and inserted.

Figure 2:
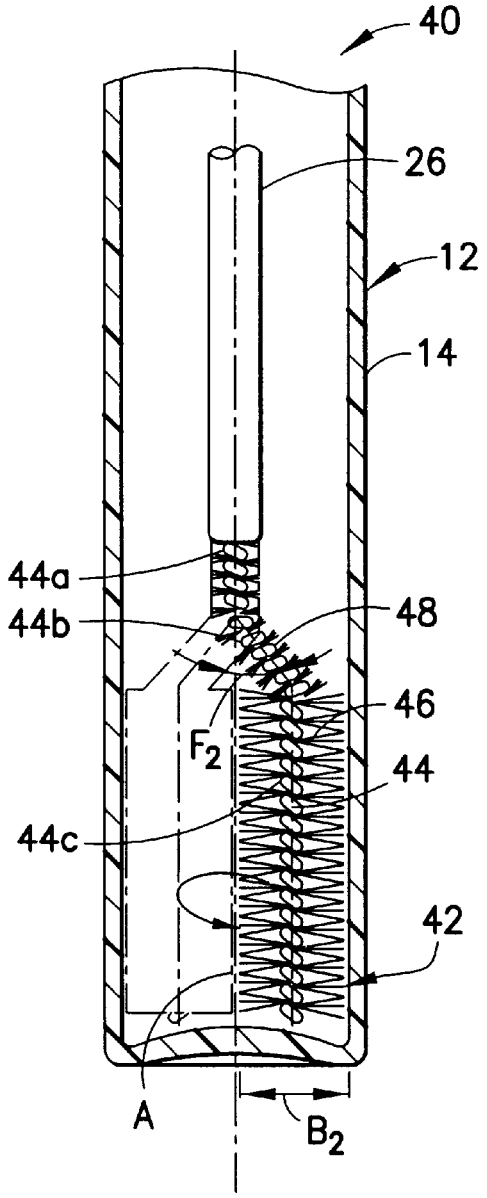
FIG. 2 is a partial cross sectional view of another cosmetics container according to the invention herein, similar to FIG. 1 but with an alternate brush.

FIG. 2 illustrates another mascara container 40 according to the invention herein. The bottle 12, wiper and cap (not shown), and applicator rod 26 are the same as those described above with respect to a mascara container 10. The mascara container 40 is characterized by a brush 42 having a twisted wire stem 44 which is bent into three portions 44*a*, 44*b* and 44*c*. Stem portion 44*a* extends downwardly from the rod 26 along the axis A of the bottle 12. Stem portion 44*b* extends at an angle $F_2$ of approximately 30 degrees from the axis A, and stem portion 44*c* extends parallel to and offset from the axis A. Portion 44*c* has bristles 46 extending therefrom, and portions 44*a* and 44*b* has shorter bristles 48 extending therefrom.

In the mascara container 40, the bristles 46 define a diameter $B_2$ of approximately 0.250 inches; however, the portion 44*c* of the twisted wire stem 44 is offset from the axis A by about 0.130 inches, so that the outer 0.030 inches of the bristles 44 engage the sidewall 14, and are somewhat bent as they lie against it. This provides a better wiping action with respect to mascara on the sidewall. The length of the bristle portions placed against the sidewall is preferably limited, so as not to greatly distort the brush or result in a permanent "bend" of some of the bristles 46 if stored for a period of time. It is believed that no more than about 0.050 to 0.060 inches of bristle length should engage the sidewall if long storage time is anticipated. Therefore, the portion of the bristles engaging the sidewall may be in the range of about 0.030 inches to about 0.060 inches.

When the cap of mascara container 40 is rotated to unthread it from the bottle 12, the portion 44*c* of the twisted wire stem 44 revolves about the axis A, and the bristles 46 extending therefrom sweep the sidewall 14 of the bottle 12 to load mascara onto the brush and to mix and stir the mascara.

In FIGS. 1 and 2, the shorter bristles on the portions 32*a*, 44*a* and 44*b* of the stems 32 and 44, respectively, also accumulate mascara product, and by virtue of the shortness of the bristles, carry a substantial amount of product with them as the brush is withdrawn from the bottle through wiper orifice 20. These areas of the stem with their shorter bristles and greater product concentration can be used to transfer mascara to eyelashes, with the longer bristles providing a combing function.

Figure 3:
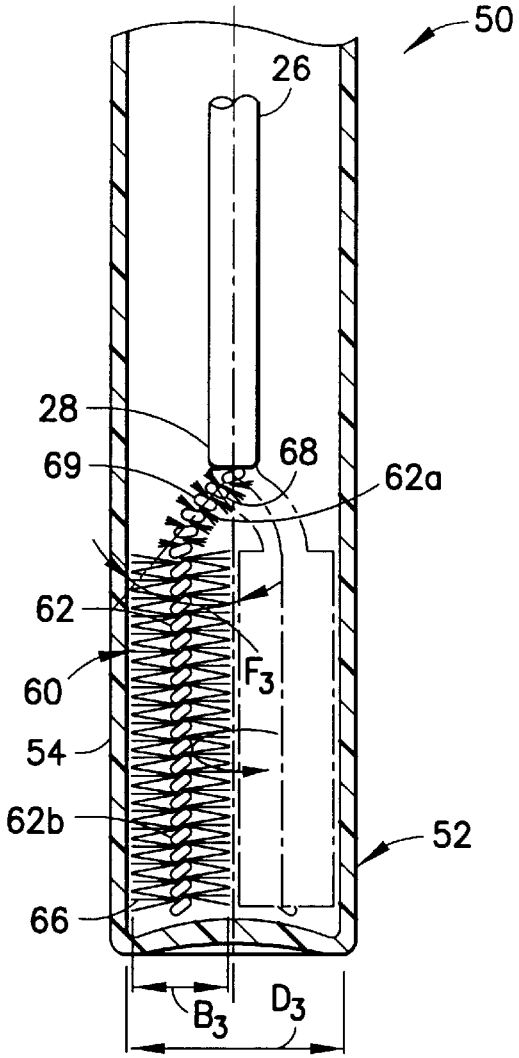
FIG. 3 is a partial cross sectional view of another cosmetics container according to the invention herein, similar to FIG. 1 but with another alternate brush.

FIG. 3 illustrates another cosmetics container 50 according to the invention herein, having a bottle 52 with sidewall 54 and a cap (not shown but similar to cap 24 and sized for bottle 52) with depending rod 26. A brush 60 is secured to the distal end 28 of the rod 26.

The brush 60 has a twisted wire stem 62 including a portion 62*a* extending outwardly from the rod at an angle $F_3$ of about 60 degrees from the axis A of the rod, and a portion of 62*b* extending parallel to and offset from the axis A. Longer bristles 66 are secured to the portion 62*b* of the twisted wire stem, and shorter bristles 68 are secured to the portion 62*a* of the twisted wire stem 62. The sharper angle of divergence from the rod provides a shoulder at 69, which may cooperate with various wiper configurations and also provides an additional application area for the mascara.

The bottle 52 has an outside diameter of 0.844 inches and an inside diameter D3 of approximately 0.764 inches. The bristles 66 extending from portion 62*b* of the twisted wire them have a diameter B3 of about 0.350 inches and are deployed with their tips closely adjacent to or just touching the sidewall 52. Thus, the offset between axis A and the portion 62*b* of the twisted wire stem is about 0.207 inches, which is achieved with the portion 62*a* of the twisted wire stem. Again, the dimensions given are design dimensions which are expected to vary by manufacturing tolerances. However, even given that the dimensions will vary somewhat, the brush 60 will sweep the sidewall 54 as the cap is twisted on and off, to utilize and stir the mascara collected there.

Figure 4:
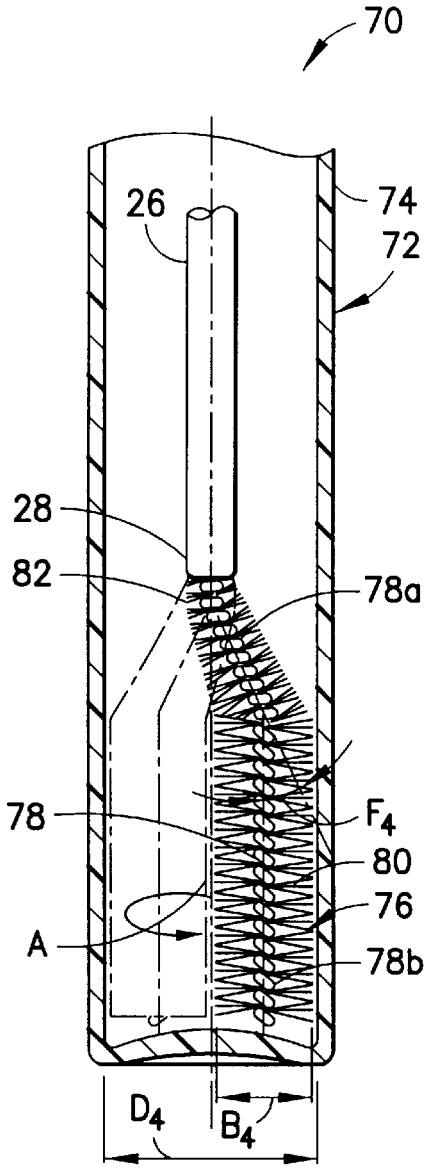
FIG. 4 is a partial cross sectional view of another cosmetics container according to the invention herein, similar to FIG. 1 but with another alternate brush.

FIG. 4 illustrates another mascara container 70 according to the invention, which has a bottle 72 with sidewall 74, and a cap (not shown) with a depending rod 26. A brush 76 is secured to the distal end 28 of the rod, and has a twisted wire stem 78 with a first portion 78*a* extending at angle $F_4$ of approximately 45 degrees from the axis A of the rod and a second portion 78*b* parallel to and offset from the axis A of the rod. The portion 78*b* of the twisted wire stem has longer bristles 80, and the portion 78*a* also has bristles 82, which may be trimmed to taper into the bristles 80.

Bottle 72 has an outside diameter of 0.640 inches and an inside diameter $D_4$ of about 0.570 inches. The portion of the brush formed about stem portion 78*b* has a diameter of about 0.300 inches and stem portion 78*b* is offset from axis A by about 0.150 inches, so that the distance between stem 78*b* and the sidewall 74 is about 0.135 inches, i.e., about 0.015 inches less than the radius of the brush. Thus, the bristles positively but lightly sweep the sidewall as the cap of the mascara container 70 is twisted on and off.

The use of a twisted wire brush permits fabricating the mascara containers 10, 40, 50 and 70 with standard componentry rods and caps, with the offsets being provided by bending the twisted wire brushes. The amount and angles of the bends are easily achieved and can also be easily varied for different desired characteristics of the overall mascara container.

All of the mascara containers 10, 40, 50 and 70 therefore have brushes which pick up mascara from adjacent the sidewalls 14 of their respective bottles, with the benefits discussed above and other benefits apparent to those skilled in the art, including ease of manufacture and flexibility of configuration and use. It will be appreciated that the embodiments disclosed are illustrative, and that the scope of the invention is limited only by the following claims.

What is claimed is:

1. A mascara container comprising:

A) an elongated bottle having a continuous sidewall defining a product reservoir;

B) the bottle having a threaded neck with an apertured wiper mounted thereon, providing access to the product reservoir;

C) a cap removably threaded onto the neck of the bottle;

D) a rod extending from the cap, said rod extending through the apertured wiper and having a distal end positioned generally centrally with respect to the continuous sidewall when the cap is secured on the bottle; and E) a brush having a stem formed independently of the rod and mounted at the distal end of the rod, the brush having a first portion extending outwardly toward the continuous sidewall and a second portion extending downwardly along the continuous sidewall, at least said second portion of the brush having bristles deployed for sweeping product from the continuous sidewall of the elongated bottle as the threaded cap is removed from and replaced on the threaded neck of the bottle.

2. A mascara container as defined in claim 1 wherein the brush has a twisted wire stem and the bristles extend generally radially outwardly therefrom.

3. A mascara container as defined in claim 2 wherein the second portion of the brush has a diameter of between about 0.200 inches and 0.400 inches.

4. A mascara container as defined in claim 2 wherein a first portion of the twisted wire stem forming the first portion of the brush extends outwardly from an axis A of the rod at an angle F, and the second portion of the twisted wire stem forming the second portion of the brush is offset from and generally aligned with the axis A of the rod.

5. A mascara container as defined in claim 4 wherein the angle F is in the range of about 15 degrees to about 60 degrees.

6. A mascara container as defined in claim 4 wherein the angle F is in the range of about 20 degrees to about 45 degrees.

7. A mascara container as defined in claim 2 wherein the first portion of the brush also has bristles and the bristles comprising the first portion of the brush are shorter than the bristles comprising the second portion of the brush.

8. A mascara container as defined in claim 2 wherein the bristles comprising the second portion of the brush extend to closely adjacent the continuous sidewall.

9. A mascara container as defined in claim 2 wherein the bristles comprising the second portion of the brush touch the continuous sidewall of the bottle.

10. A mascara container as defined in claim 2 wherein the bristles comprising the second portion of the brush are longer than the distance between the twisted wire stem and the sidewall, wherein the bristles engage with the sidewall.

11. A mascara container as defined in claim 10 wherein the bristles comprising the second portion of the brush are longer than the distance between the stem and the sidewall by about 0.030 inches to about 0.060 inches.

12. A mascara container as defined in claim 1 wherein the bristles comprising the second portion of the brush extend to closely adjacent the continuous sidewall.

13. A mascara container as defined in claim 1 wherein the bristles comprising the second portion of the brush touch the continuous sidewall of the bottle.

14. A mascara container as defined in claim 1 wherein the bristles comprising the second portion of the brush are longer than the distance between the stem and the sidewall, wherein the bristles engage with the sidewall.

15. A mascara container as defined in claim 1 wherein the elongated bottle is cylindrical.

16. A mascara container as defined in claim 15 wherein the wiper orifice is deployed on a central longitudinal axis A of the elongated bottle.

17. A mascara container as defined in claim 1 wherein the elongated bottle has an inside diameter in the range of about 0.500 inches to about 0.800 inches.

18. A mascara container as defined in claim 17 wherein the second portion of the brush has a diameter between about 0.200 inches to about 0.350 inches.

19. A mascara container as defined in claim 1 wherein the first portion of the brush also has bristles, the bristles on the first portion of the brush are shorter than the bristles on the second portion of the brush.

20. An applicator for use with a mascara container of the type having a bottle having a continuous sidewall defining a product reservoir, the bottle having a threaded neck with an apertured wiper mounted thereon providing access to the product reservoir, the applicator comprising:

A) a cap removably threadable onto the neck of the bottle and thereby adapted to close the mascara container;

B) a rod extending from the cap, said rod extending through the apertured wiper and having a longitudinal axis extending to a distal end positioned generally centrally with respect to the continuous sidewall when the cap is secured on the bottle; and C) a brush having a stem formed independently of the rod and mounted to the distal end of the rod, the brush having a first portion extending outwardly from the longitudinal axis of the rod and a second portion extending downwardly along the longitudinal axis of the rod and offset therefrom, at least the second portion of the brush having bristles deployed for sweeping product from the continuous sidewall of the elongated bottle as the threaded cap is removed therefrom.

* * * * *